US008140245B2

(12) United States Patent
Leanos et al.

(10) Patent No.: US 8,140,245 B2
(45) Date of Patent: Mar. 20, 2012

(54) ENGINE WITH ELECTRONICALLY CONTROLLED STARTING METHOD

(75) Inventors: Alfredo Leanos, Chicago, IL (US); Paul Gottemoller, Palos Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 218 days.

(21) Appl. No.: 12/611,330

(22) Filed: Nov. 3, 2009

(65) Prior Publication Data

US 2011/0106414 A1 May 5, 2011

(51) Int. Cl.
*F02D 41/30* (2006.01)

(52) U.S. Cl. ..... 701/104; 701/110; 701/113; 123/491; 123/436

(58) Field of Classification Search ..... 123/491, 123/435–436, 179.3, 179.12, 179.14, 179.16; 701/104, 110, 111, 113
See application file for complete search history.

(56) References Cited

U.S. PATENT DOCUMENTS 6,722,332 B2 * 4/2004 Kojima ..... 123/179.3
7,524,266 B2 * 4/2009 Nobumoto et al. ..... 477/110

* cited by examiner

*Primary Examiner* — Hai Huynh
(74) *Attorney, Agent, or Firm* — Mark C. Bach; Jeffrey P. Calfa

(57) ABSTRACT

A method of starting an engine is provided. A starter is initiated to impart a first engine speed to a crankshaft of the engine. Fuel injects at a first rate into at least one cylinder of the engine. Fuel in the at least one cylinder of the engine combusts to operate the engine at generally the first speed imparted to the crankshaft of the engine by the starter until a predetermined oil pressure develops within the engine.

18 Claims, 2 Drawing Sheets

ENGINE WITH ELECTRONICALLY CONTROLLED STARTING METHOD

TECHNICAL FIELD

The present disclosure relates to an engine having an electronically controlled engine starting method, and more particularly to an electronically controlled starting method to provide lubrication to engine components before the engine operates at normal operating speeds.

BACKGROUND

Many modern diesel engines contain fuel injection systems that allow the engine to start at low ambient temperatures without starting aids. When an engine is started, a lag time exists until a sufficient amount of engine oil circulates to lubricate engine components such as crankshaft bearings, connecting rod bearings, and turbocharger bearings. The lag time between engine starting and circulation of engine oil sufficient to lubricate engine components increases when ambient temperature is lower, particularly when engine oil has a larger viscosity number. The lag in sufficient lubrication to lubricate engine components may result in damage to components of the engine, including the turbocharger. In order to limit or prevent this type of damage, an oil with a lower viscosity number may be used, such that the oil flows better at low ambient temperatures, or an engine may be provided with a block heater, or an oil heater, that warms the engine, including the oil, allowing the oil to circulate more effectively at low ambient temperatures. However, the use of oil with a lower viscosity number, an engine block heater, or an oil heater all require a vehicle operator to take action. Therefore, a need exists for an engine having an electronically controlled starting method that sufficiently lubricates engine components.

SUMMARY

According to one process, a method of starting an engine is provided. A starter is initiated to impart a first engine speed to a crankshaft of the engine. Fuel injects at a first rate into at least one cylinder of the engine. Fuel in the at least one cylinder of the engine combusts to operate the engine at generally the first speed imparted to the crankshaft of the engine by the starter until a predetermined oil pressure develops within the engine.

According to another process, a method of electronically controlling starting of an internal combustion engine is provided. The engine has an electronic control module, an oil pressure sensor, a starter, at least one cylinder, and at least one fuel injector. The method initiates a starter to start an engine. Fuel is injected at a first fuel injection rate with a fuel injector into at least one cylinder upon initiating the starter. The first fuel injection rate operates the engine at a speed generally equal to the engine speed provided by the starter. An output signal of an oil pressure sensor is generated indicative of engine oil pressure. The output signal of the oil pressure sensor is transmitted to an electronic control module. Oil pressure indicated by the output signal of the oil pressure sensor is compared to at least a first predetermined value stored in a memory of the electronic control module. At least a second fuel injection rate signal is transmitted to the fuel injector when the output of the oil pressure sensor is more than the at least a first predetermined value stored in the memory of the electronic control module. The second fuel injection rate signal corresponds to a second fuel injection rate greater than the first fuel injection rate. The second fuel injection rate allows the engine to operate at an engine speed greater than the engine speed provided by the starter.

According to a further process, a method of operating an engine is provided. The engine has an electronic control module with a memory, an oil pressure sensor, at least one cylinder, a starter, and at least one fuel injector. The method generates an output signal of an oil pressure sensor indicative of engine oil pressure. The output signal of the oil pressure sensor is transmitted to an electronic control module. The oil pressure indicated by the output signal of the oil pressure sensor is compared to at least a first predetermined value stored in a memory of the electronic control module. A first fuel injection rate signal is transmitted to a fuel injector when the output of the oil pressure sensor is less than the at least a first predetermined value stored in the memory of the electronic control module. The first fuel injection rate signal corresponds to a first fuel injection rate that causes the engine to operate at a first engine speed generally equal to an engine speed provided by a starter.

DETAILED DESCRIPTION

Figure 1:
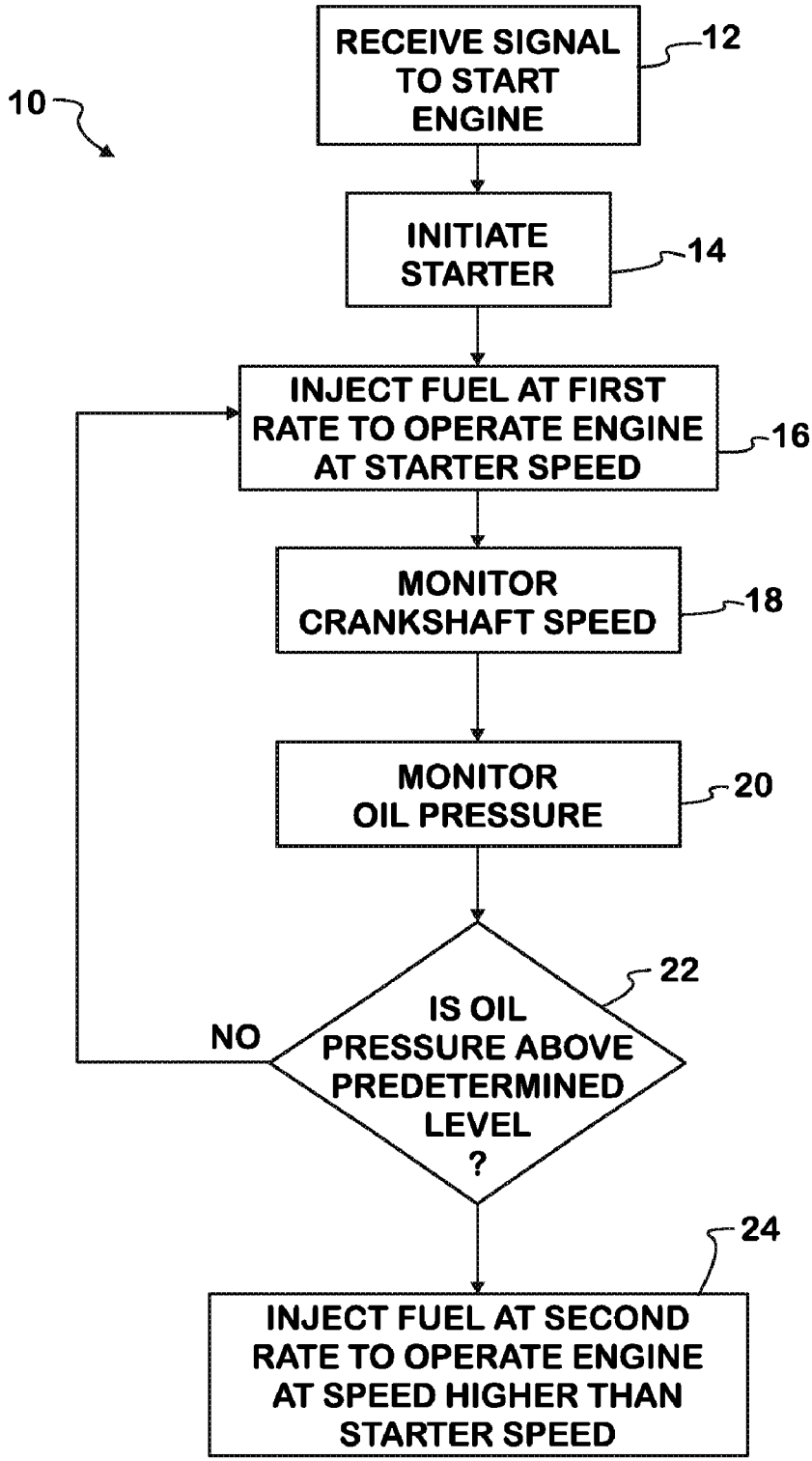
FIG. 1 is a block diagram showing a method of starting a diesel engine according to one process.

FIG. 1 shows a schematic diagram depicting a method 10 for starting an engine. The method 10 initiates at block 12 where an electronic control module ("ECM") receives a signal indicating that a switch adapted to start the engine has been engaged. The ECM generates an output signal that engages a starter as shown at block 14. The starter turns a crankshaft of the engine at a first rotational speed. As the starter turns the crankshaft, the ECM initiates a fuel injector to inject fuel into a cylinder of the engine at block 16. The fuel injector injects fuel into the cylinder at a first rate that is adapted to operate the engine such that combustion of fuel causes the crankshaft to turn at the first speed. The rotational speed of the crankshaft is monitored by a crankshaft speed sensor that generates a signal sent to the ECM as shown at block 18. An oil pressure sensor generates an output signal that is communicated to the ECM as shown at block 20.

The ECM has a memory containing at least one oil pressure threshold value. The ECM compares the output signal of the oil pressure sensor to the at least one oil pressure threshold value at block 22. If the output signal of the oil pressure sensor is less than the at least one oil pressure threshold value, the process returns to block 16, where fuel is injected at the first rate to operate the engine so that the crankshaft turns at the first speed. However, if the output signal of the oil pressure is above the threshold value, the ECM initiates the fuel injector to inject fuel into the cylinder of the engine at a second rate that is higher than the first rate, as shown at block 24. The second rate of fuel injection is adapted to operate the engine such that the crankshaft turns at a second speed that is faster than the first speed.

Figure 2:
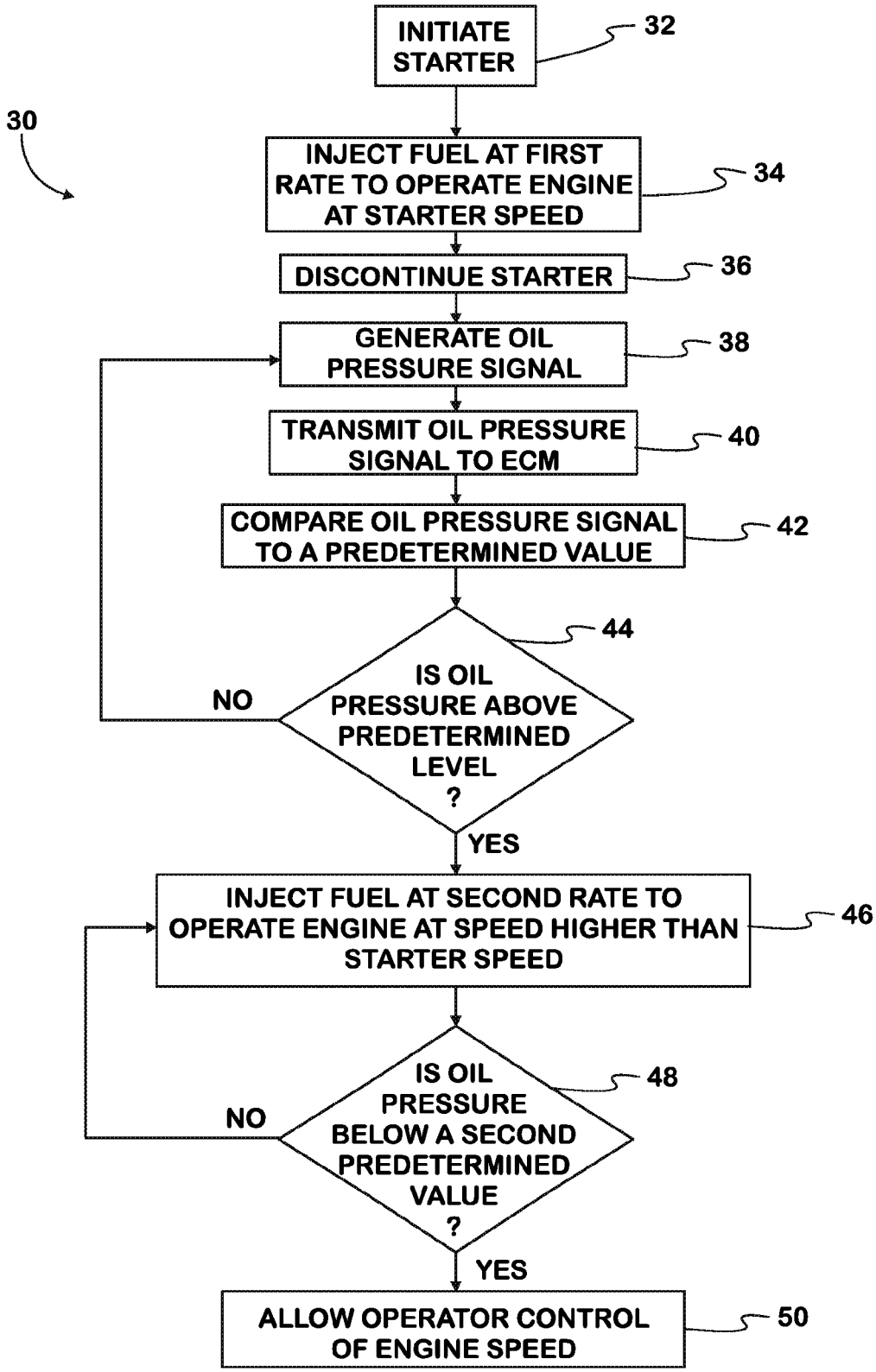
FIG. 2 is a block diagram showing another method of operating a diesel engine according to another process.

Turning now to FIG. 2, another schematic diagram depicts another method 30 for starting an engine. The method initiates operation of a starter at block 32. Once the starter is initiated, fuel is injected into the engine at a first rate, such that combustion of fuel within the engine operates the engine at a speed generally equal to the crankshaft rotation speed provided by the starter at block 34. Fuel may be injected into the engine at a first rate in response to a first fuel injection rate signal that is transmitted wither directly or indirectly to a fuel injector. Once fuel is combusting operation of the starter is discontinued at block 36.

An oil pressure sensor generates an oil pressure output signal at block 38 that is transmitted to an ECM at block 40. The ECM compares the oil pressure output signal with at least a first predetermined value stored in a memory in electrical communication with the ECM, as shown at block 42. As shown at block 44, if the oil pressure is not above the at least a first predetermined value, the method reverts back to block 38 and continues to compare the oil pressure sensor signal to the first predetermined value. However, if the oil pressure is above the at least a first predetermined value, fuel is injected at a second rate that is greater than the first rate to increase the rotational speed of the crankshaft of the engine, as shown at block 46. The fuel may be injected at the second rate in response to a second fuel injection rate signal being transmitted either directly or indirectly to the fuel injector.

After fuel has been injected at the second rate, the oil pressure signal is compared to a second predetermined value as shown at block 48. If the oil pressure signal is above the second predetermined value, fuel continues to be injected at the second rate. If the oil pressure signal is less than the second predetermined value, the method allows control of the speed of the crank to be controlled by the user, as shown at block 50. Preventing a user from operating the engine at a speed the user desires if the oil pressure is above the second predetermined value reduces the chances that the engine may be damaged if the engine is operating in a very cold ambient temperature before the oil has a chance to warm up. Thus, the method 30 shown in FIG. 2 operates an engine at a slow speed, generally the speed of the starter, until oil pressure reaches a first predetermined value, and prevents the engine from operating at a very high speed if the oil pressure is above a second predetermined value thereby reducing the likelihood of the engine being damaged soon after startup.

It is additionally contemplated that the first predetermined value stored in a memory in communication with the ECM that the oil pressure signal is compared to is temperature dependent. For instance, it is contemplated that lower ambient temperatures will have higher first predetermined values than higher ambient temperatures, as colder oil is less viscous.

It is additionally contemplated that an engine will only be run for a limited time period at the first speed that is generally equal to the speed provided by the starter. If the oil pressure does not reach the first predetermined value by the end of that limited time period, the engine is shut down, and an error code is generated by the ECM that indicates low oil pressure.

It is still further contemplated that operating the engine at a speed generally equal to the speed of the starter may not require fuel to be injected into every cylinder of an engine having a plurality of cylinders. For instance, it is contemplated that every other cylinder of an engine having a plurality of cylinders would be fired. Firing every other cylinder may reduce complications from torsional vibrations generated by operating an engine at very low speeds.

What is claimed is:

1. A method of starting an engine comprising:

initiating a starter to impart a first engine speed to a crankshaft of the engine;

injecting fuel at a first rate into at least one cylinder of the engine;

combusting fuel in the at least one cylinder of the engine to operate the engine at generally the first speed imparted to the crankshaft of the engine by the starter until engine oil pressure reaches a predetermined threshold; and injecting fuel at a second rate into the cylinder of the engine after the predetermined threshold develops, wherein the second rate is greater than the first rate.

2. The method of claim 1, wherein operating the engine at generally the first speed is limited to a time period less than a predetermined time period.

3. The method of claim 1, wherein the predetermined threshold is based upon ambient temperature.

4. The method of claim 1, further comprising monitoring engine oil pressure using an oil pressure sensor disposed in electrical communication with an electronic control module.

5. The method of claim 1 further comprising stopping the starter after the combusting of fuel in the at least one cylinder of the engine begins.

6. A method of electronically controlling starting of an internal combustion engine, the engine having an electronic control module, an oil pressure sensor, a starter, at least one cylinder, and at least one fuel injector, the method comprising:

initiating a starter to start an engine;

injecting fuel at a first fuel injection rate with into at least one cylinder upon initiating the starter, the first fuel injection rate operating the engine at a speed generally equal to the engine speed provided by the starter;

generating an output signal of an oil pressure sensor indicative of engine oil pressure;

transmitting the output signal of the oil pressure sensor to an electronic control module;

comparing oil pressure indicated by the output signal of the oil pressure sensor to at least a first predetermined value stored in a memory of the electronic control module; and transmitting at least a second fuel injection rate signal corresponding to a second fuel injection rate when the output of the oil pressure sensor is more than the at least a first predetermined value stored in the memory of the electronic control module, the second fuel injection rate being greater than the first fuel injection rate, the second fuel injection rate and allowing the engine to operate at an engine speed greater than the engine speed provided by the starter.

7. The method of electronically controlling starting of an internal combustion engine of claim 6 further comprising transmitting a first fuel injection rate signal when the output of the oil pressure sensor is less than the at least a first predetermined value stored in the memory of the electronic control module, the first fuel injection rate signal corresponding to the first fuel injection rate.

8. The method of electronically controlling starting of an internal combustion engine of claim 7 further comprising:

generating an output signal of an engine speed sensor indicative of engine speed;

comparing engine speed indicated by the output signal of the engine speed sensor to at least a second predetermined value stored in a memory of the electronic control module; and transmitting a modified first fuel injection rate signal when the output of the engine speed sensor is less than the at least the second predetermined value stored in the memory of the electronic control module, the modified first fuel injection rate being greater than the first fuel injection rate.

9. The method of claim 6, wherein the first predetermined value is based upon ambient temperature.

10. The method of claim 6, further comprising combusting fuel within the at least one cylinder in response to the injecting fuel at a first fuel injection rate into the at least one cylinder.

11. The method of claim 10, wherein combusting of fuel within the at least one cylinder disengages the starter.

12. The method of claim 6, further comprising stopping injection of fuel into the at least one cylinder when the output of the oil pressure sensor is less than the at least a first predetermined value stored in the memory of the electronic control module at a predetermined time after injecting fuel at the first fuel injection rate.

13. A method of operating an engine, the engine having an electronic control module with a memory, an oil pressure sensor, at least one cylinder, a starter, and at least one fuel injector, the method comprising:

generating an output signal of an oil pressure sensor indicative of engine oil pressure;

transmitting the output signal of the oil pressure sensor to an electronic control module;

comparing oil pressure indicated by the output signal of the oil pressure sensor to at least a first predetermined value stored in a memory of the electronic control module; and transmitting a first fuel injection rate signal when the output of the oil pressure sensor is less than the at least a first predetermined value stored in the memory of the electronic control module, the first fuel injection rate signal corresponding to a first fuel injection rate, causing the engine to operate at a first engine speed generally equal to an engine speed provided by a starter; and transmitting a second fuel injection rate signal when the output of the oil pressure sensor is more than the at least the first predetermined value stored in the memory of the electronic control module, the second fuel injection rate signal corresponding to a second fuel injection rate, causing the engine to operate at engine speeds greater than the first engine speed.

14. The method of claim 13, wherein the second fuel injection rate causes the engine to operate at a low idle speed.

15. The method of claim 13, further comprising transmitting a second fuel injection rate signal when the output of the oil pressure sensor is more than the at least the first predetermined value stored in the memory of the electronic control module and less than at least a second predetermined value stored in the memory of the electronic control module, the second fuel injection rate signal corresponding to a second fuel injection rate, causing the engine to operate at engine speeds greater than the first engine speed.

16. The method of claim 15, further comprising stopping sending of the first fuel injection rate signal when the output of the oil pressure sensor is less than the at least a first predetermined value stored in the memory of the electronic control module at a predetermined time.

17. The method of claim 15, wherein the second predetermined value is based upon ambient temperature.

18. The method of claim 13, wherein the first predetermined value is based upon ambient temperature.

* * * * *